US005371657A

United States Patent [19]

Wiscombe

[11] Patent Number: 5,371,657

[45] Date of Patent: Dec. 6, 1994

[54] PLIABLE ILLUMINATED FABRIC ARTICLES

[76] Inventor: Brent Wiscombe, 735 W. Medina, Mesa, Ariz. 85210.

[21] Appl. No.: 120,481

[22] Filed: Sep. 13, 1993

[51] Int. Cl.[5] ..... F21V 33/00; F21L 15/08

[52] U.S. Cl. ..... 362/103; 362/806; 2/243.1; 2/115

[58] Field of Search ..... 362/103, 108, 800, 84, 362/105, 106; 2/115, 244, 160, 167, 169, 243.1

[56] References Cited

U.S. PATENT DOCUMENTS

| | | | |
|---|---|---|---|
| 4,164,008 | 8/1979 | Miller et al. | 362/103 |
| 4,570,206 | 2/1986 | Deutsch | 362/103 |
| 4,602,191 | 7/1986 | Davila | 315/76 |
| 4,709,307 | 11/1987 | Branom | 362/103 |
| 4,774,434 | 9/1988 | Bennion | 313/500 |
| 5,128,843 | 7/1992 | Guritz | 362/103 |

*Primary Examiner*—Ira S. Lazarus
*Assistant Examiner*—Thomas M. Sember

[57] ABSTRACT

An illuminated fabric article (10) includes a flexible substrate sheet (34) to which conductive ink traces (38) and lights (20) attach. The substrate sheet (34) has a low resilience so as not to press against skin (12) after it wrinkles or otherwise deforms to accommodate body (14) curves and movement. A cloth material having a thin flexible polymer film (40) applied over a woven cloth backing (42) represents one example of a suitable substrate sheet (34). A conductive ink which remains flexible after curing is applied to the substrate sheet (34) to form the conductive traces (38), which convey electrical energization to the lights (20). Each light (20) attaches to the substrate sheet (34) and to the conductive traces (38) through the use of a non-conductive adhesive patch (64) and two conductive adhesive patches (66). The lights (20) on the substrate sheet (34) are arranged to be visible from an exterior side (28) of a textile (26) so that they may be visually perceived from a distance.

16 Claims, 3 Drawing Sheets

FIG. 3
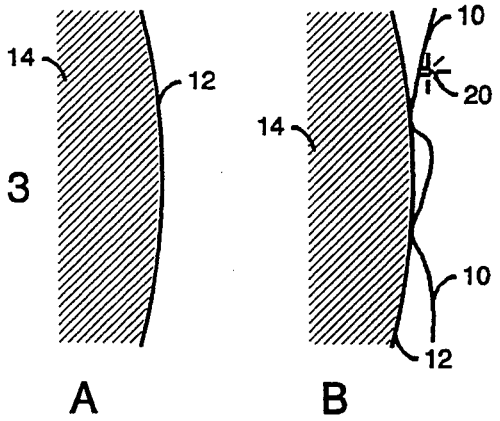
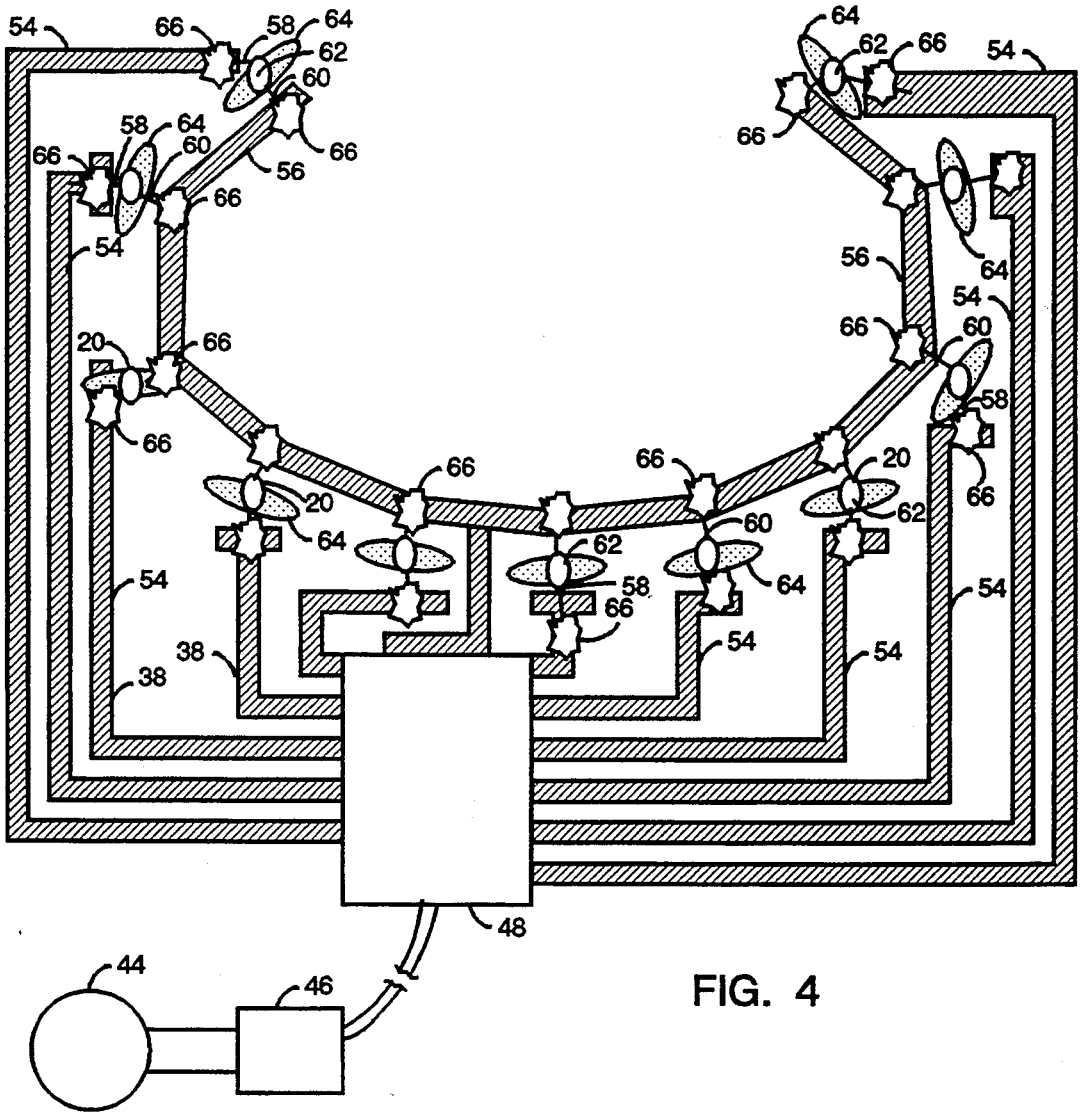
FIG. 4

PLIABLE ILLUMINATED FABRIC ARTICLES

TECHNICAL FIELD OF THE INVENTION

The present invention relates generally to fabric articles, such as clothing, flags, curtains, tapestries, and the like, which incorporate electrically operated lights. More specifically, the present invention relates to illuminated fabric articles which substantially exhibit cloth-like pliability and the low resilience that is characteristic of cloth.

BACKGROUND OF THE INVENTION

A visual design displayed by a fabric article contributes greatly to the desirability of that article. Manufacturers expend great effort in creating and providing fabric articles that have desirable designs, and consumers expend great effort in seeking out fabric articles which have desirable designs. The most common sources of visual information emanating from a fabric article's design come from the fabric itself and from silk-screening or otherwise painting on the fabric. These are passive designs because they are viewed only after light passively reflects from the designs. However, active sources can provide another dimension to the visual information emanating from fabric articles.

Over the years, numerous attempts have been made at configuring fabric articles, and particularly clothing, to include electrically operated lights. None of these attempts have achieved wide-spread acceptance by consumers. Consumers have rejected prior illuminated clothing attempts due to discomfort and high costs. The discomfort results, in large part, because conventional illuminated fabric articles fail to approximate the light weight, pliability, and/or low resilience which characterize textiles from which fabric articles are made. Even though the design of an article of clothing is very important to a consumer, comfort for the wearer of an article of clothing is also important. When an article of illuminated clothing is uncomfortable to wear, the desirability of including lights in the clothing design diminishes considerably. And, this diminishment compounds if the article of clothing is also expensive.

Early illuminated articles of clothing have been uncomfortable and costly because they rely on conventional electrical circuit techniques. Some articles have incorporated conventional fiberglass or otherwise rigid printed circuit boards in the article of clothing. Often times, multiple boards are coupled together and to energization sources through wires which rub against the body. Unfortunately, wearing rigid circuit boards and wiring underneath clothing is extremely uncomfortable, and the level of discomfort increases as the size and weight of the circuit board or boards increase.

Others apparently recognize the discomfort problem caused by rigid and heavy circuitry. Their articles attempt to provide clothing that includes a circuit sheet. The circuit sheet includes a thin, supple, flexible, insulating film material as a substrate upon which a conductive pattern is formed. In attempting to provide a thin, supple, and flexible film, they rely upon such expensive materials as Mylar, Kapton, and Polyester for the insulating film material and upon expensive conventional copper cladding techniques to provide a conductive pattern. Although costly, the resulting circuit sheet may be supple and flexible when compared to rigid fiberglass printed circuit boards.

However, when compared to the skin against which the circuit sheet is worn, it is neither supple nor flexible. Consequently, when normal body movements force the circuit sheet against and into the skin, the skin deforms from its set shape far more readily than the circuit sheet deforms from its set shape. Moreover, these substrate and conductive pattern materials are substantially resilient so that they continue to press against the body even after they flex in response to normal body movements. This continued pressure produces annoying skin irritation. Still further, these substrate and conductor materials do not breath or absorb moisture. Consequently, the body has trouble cooling itself where the circuit sheet resides and body perspiration tends to accumulate. In short, prior attempts at providing illuminated clothing which promote comfort have been unsuccessful.

SUMMARY OF THE INVENTION

Accordingly, it is an advantage of the present invention that an improved illuminated fabric article is provided.

Another advantage of the present invention is that an illuminated fabric article is provided which, when worn as clothing, promotes comfort.

Another advantage is that the present invention provides an article of illuminated clothing that readily flexes or deforms when forced against a body.

Another advantage is that the present invention provides an illuminated fabric article that has very low resilience or springiness and refrains from pressing against the body after it has deformed.

Another advantage is that the present invention provides an illuminated fabric article which reduces interference with normal body perspiration functions.

Another advantage is that the present invention provides an illuminated fabric article that is inexpensive.

The above and other advantages of the present invention are carried out in one form by an illuminated fabric article which substantially exhibits cloth-like pliability and low resilience. The article includes a textile having an exterior side and an interior side. A substantially continuous, pliable film is juxtaposed with the textile. A flexible conductive ink resides on a surface of the film and is configured to form first and second conductive traces on the film. At least one light physically attaches to the film. This light is arranged to be visible from the exterior side of the textile.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 3 shows comparative illustrations "A" and "B" that depict a set shape of a body when no article of clothing is being worn and when an illuminated fabric article configured in accordance with the present invention is being worn;

FIG. 4 shows a top view of a substrate sheet portion of the illuminated fabric article;

DETAILED DESCRIPTION OF THE PREFERRED EMBODIMENTS

Figure 1:
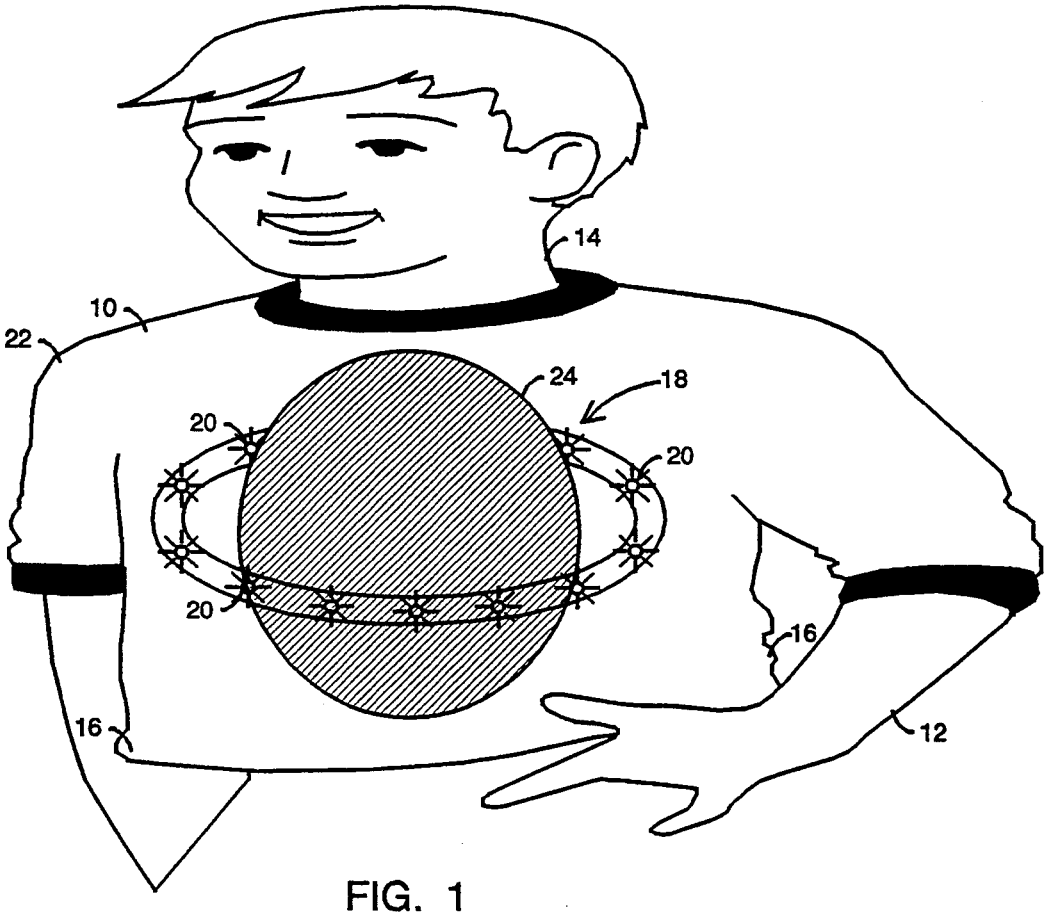
FIG. 1 shows an illuminated fabric article which exhibits cloth-like pliability and low resilience and is configured as an article of clothing.

FIG. 1 shows an illuminated fabric article 10 formed into an item of apparel and configured in accordance with the teaching of the present invention. FIG. 1 illustrates article 10 as being formed into a T-shirt, but this is not a requirement of the present invention. Article 10 may desirably be configured as any item of apparel which is worn close to the skin 12 of a body 14. As is normal for any item of apparel, article 10 is free to bend, wrinkle, pucker, and otherwise deform 16 as needed to accommodate the curved shape of body 14. Moreover, as various portions of body 14 move relative to other portions, article 10 is free to deform its shape as needed to accommodate such movement. Furthermore, article 10 need not be formed only into items of apparel but may also be formed into flags, curtains, tapestries, and other articles that include fabrics, textiles, cloth, and the like.

Article 10 carries a design 18 which may be visually perceived from a distance. Design 18 includes one or more active lights 20. Lights 20 actively shine and do not rely upon reflection from an external light source. In the preferred embodiments, lights 20 are electrically energized and are visible from an exterior side 22 of article 10. Design 18 may additionally include a passive design 24, which results from a fabric pattern, silk-screening, painting, or other design technique. Lights 20 may desirably integrate with passive design 24 so that design 18 represents a combination of active and passive features. The example design 18 shown in FIG. 1 illustrates a planet with rings, where lights 20 reside in the rings. Of course, those skilled in the art will appreciate that the present invention applies to any type of design and is not limited to the example shown in FIG. 1.

Figure 2:
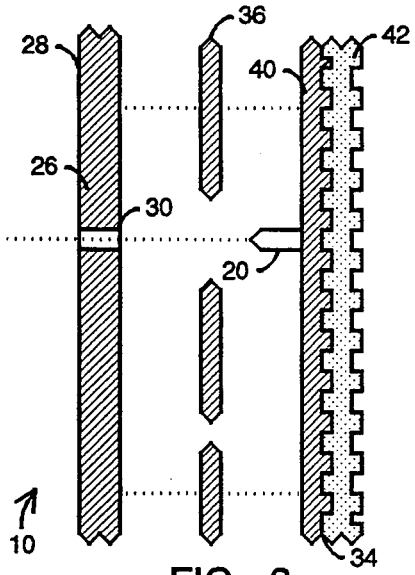
FIG. 2 shows an exploded side view of a section of a first embodiment of the illuminated fabric article.

FIG. 2 shows an exploded side view of a section from a first embodiment of illuminated fabric article 10. A textile or garment material 26 forms an exterior layer of article 10. Textile 26 represents any conventional fabric or other sheet-like material used in the construction of fabric articles. An exterior side 28 of textile 26 serves as the outside of article 10 and is the side of article 10 from which design 18 (see FIG. 1) and lights 20 may be viewed.

A hole 30 may be made through textile 26, between exterior side 28 and an interior side 32, to accommodate a light 20. Hole 30 is located at any desirable location relative to design 18 (see FIG. 1). When article 10 is assembled, light 20 is visible through hole 30.

Article 10 additionally includes an electrically insulating substrate sheet 34 which attaches to interior side 32 of garment material 26 through an adhesive layer 36. Adhesive layer 36 need not be continuously applied over the area covered by substrate sheet 34, and may include numerous gaps. Preferably, adhesive layer 36 is electrically non-conductive conductive and remains pliable after setting. One product which remains suitably pliable is sold under the tradename 107-36 by Creative Materials of Tyngsboro, Mass., but other adhesives known to those skilled in the art may be used as well.

Light 20 attaches to conductive traces 38, which are shown in FIG. 4. Conductive traces 38 are formed by lines of flexible, conductive ink applied to a surface of substrate 34. The ability of substrate sheet 34 to carry conductive traces 38 (see FIG. 4) is important to the operation of light 20. However, the nature and makeup of substrate sheet 34 contribute to the ability of article 10 to promote comfort while functioning as an electrical circuit.

In this first embodiment, substrate sheet 34 includes a substantially continuous film layer 40 overlaid upon a woven, cloth backing 42. Film layer 40 carries conductive traces 38 (see FIG. 4) and faces textile 26. Film layer 40 is desirably a relatively smooth and continuous, flexible, polymeric material which is both electrically insulating and pliable. A thin rubber layer serves as layer 40 in the preferred embodiments, but soft and pliable plastic or vinyl materials may also be used.

Film layer 40 is substantially continuous to provide an effective base upon which conductive traces 38 are applied. The continuous nature of film layer 40 means that gaps between the fibers from which layer 40 is formed are so small that they are insignificant for the purposes of supporting continuous runs of conductive ink. Thus, the conductive ink likewise remains continuous after curing, and circuit opens are avoided.

Woven cloth backing 42 is generally not continuous. The formation of a sheet material by weaving produces "hills and valleys." FIG. 2 exaggerates these hills and valleys for clarity of illustration. Due to the hills and valleys, cloth backing 42 is not a suitable base for conductive ink traces because of wicking and an increased likelihood of circuit opens after curing.

But, the woven character of layer 42 makes layer 42 extremely pliable. Due to weaving, cloth layer 42 readily forms wrinkles and puckers or otherwise deforms to accommodate movement and curves in body 14 (see FIG. 1). And, layer 42 has substantially no "set" shape or orientation. Once layer 42 bends, puckers, wrinkles, or otherwise deforms or changes its shape, the lack of resilience in layer 42 tends to allow layer 42 to remain in the new shape without exerting or experiencing internal forces which urge layer 42 to assume any other shape.

In the preferred embodiment, film layer 40 is desirably much thinner than cloth layer 42. In fact, a conventional rubberized cloth material may suffice for substrate sheet 34. Consequently, substrate sheet 34 generally exhibits the pliability, strength, and lack of resilience characteristics of cloth layer 42. It is this pliability and lack of resilience in substrate sheet 34 which allow article 10 to promote comfort. The strength of substrate sheet 34 comes primarily from woven cloth layer 42, with film layer 40 serving primarily to provide a smooth continuous layer that is suitable for the attachment of conductive traces 38.

FIG. 3 shows comparative illustrations "A" and "B" that depict a portion of body 14. Body 14 typically has a set shape, which is schematically depicted in illustration A. When an object with greater rigidity than the low rigidity of skin 12 is forced or otherwise pressed against skin 12, skin 12 deforms. However, internal pressures of body 14 apply a counter force that urges skin 12 back to its set shape. Due to the woven, cloth character of substrate sheet 34 and of textile 26 (see FIG. 2), article 10 bends, puckers, wrinkles, or otherwise deforms readily so that skin 12 does not deform any significant amount when article 10 contacts skin 12, as depicted in illustration B. Moreover, article 10 has substantially no set shape. Thus, when article 10 does deform, the pressure exerted by article 10 against body 14 after deformation of article 10 is approximately equal to or less than the opposing pressure body 14 exerts on skin 12 and article 10 at the point of contact. As depicted in illustration B of FIG. 3, body 14 may come into contact with article 10 through normal wearing situations, and article 10 more readily deforms and holds a deformed shape than skin 12. This feature promotes comfort.

Referring back to FIG. 2, another feature which promotes comfort is cloth layer 42 facing the inside of article 10. If article 10 is worn directly against skin 12 (see FIG. 1), cloth layer 42 and not film layer 40 contacts skin 12. Due to the woven, cloth nature of cloth layer 42, moisture wicks through cloth layer 42 and cloth layer 42 breaths. Since layer 42 breaths and wicks moisture, the perspiratory cooling functions of body 14 operate in a more normal manner than if a plastic or non-breathing material were held next to skin 12. Thus, the use of cloth layer 42 on the inside of article 10 further promotes comfort.

FIG. 4 shows a top view of substrate sheet 34. In particular, FIG. 4 shows the side of substrate sheet 34 that faces textile 26 in the first embodiment illustrated in FIG. 2 and upon which conductive traces 38 are formed and lights 20 attach.

Electrically, article 10 includes a battery 44 which serves as a source of energization for lights 20. Battery 44 is preferably a thin, "button" battery of the type commonly used in cameras. Battery 44 couples to an optional sequencer or timing circuit 46. Timing circuit 46 applies energization to lights 20 in a predetermined order and in accordance with a predetermined timing pattern. Thus, lights 20 may flash on and off in accordance with a predetermined sequence. A switch (not shown) may be inserted between battery 44 and timing circuit 46 to disable light flashing. Timing circuit 46 couples, perhaps through an optional connector 48, to conductive traces 38. Lights 20 directly connect to conductive traces 38. In the preferred embodiments, lights 20 are conventional light emitting diodes (LEDs).

Physically, battery 44 and timing circuit 46 may be located at any desirable location in article 10. For example, battery 44 and timing circuit 46 may be located in a pocket formed some distance from design 18 (see FIG. 1), and connections to conductive traces may be provided by a flexible cable and connector 48. On the other hand, battery 44 and timing circuit 46 may physically attach to the same side of substrate sheet 34 that supports conductive traces 38. That way, the electrical connections between battery 44, timing circuit 46, and conductive traces 38 may be provided by conductive ink, and connector 48 may be omitted.

Figure 5:
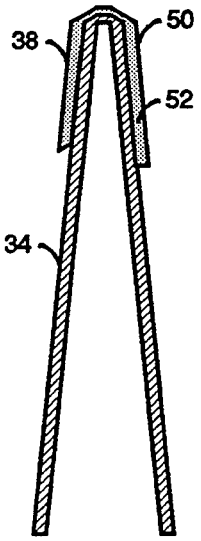
FIG. 5 shows a side view of a section of the substrate sheet upon which a conductive trace resides.

FIG. 5 shows a side view of a section of substrate sheet 34 upon which a conductive trace 38 resides. Conductive traces 38 are provided by a liquid polymeric ink 50 that sets into a flexible structure, as illustrated in FIG. 5. Ink 50 carries electrically conductive particles 52, such as silver. After setting, particles 52 conduct electricity. A material sold under the tradename 102-05F by Creative Materials of Tyngsboro, Mass. provides one suitable conductive ink 50 which is flexible when cured and which adheres to film 40 of substrate 34.

With reference back to FIG. 4, ink 50 is applied in a desired pattern to form conductive traces 38. Typically, each light 20 couples between an active conductive trace 54 and a common or ground conductive trace 56. Each light 20 may use the same ground trace 56. Traces 54 and 56 are routed so as not to short and so that they come close together in the positions where lights 20 are to be located within design 18 (see FIG. 1).

Each light 20 includes anode and cathode conductive leads 58 and 60, respectively. Leads 58 and 60 each protrude from spaced apart locations on the bottoms of lights 20. Leads 58 and 60 are bent or otherwise arranged so that they may contact active and ground traces 54 and 56, respectively. Moreover, leads 58 and 60 are arranged so that bodies 62 of lights 20 can contact or nearly contact substrate sheet 34 when leads 58 and 60 contact traces 54 and 56.

Lights 20 attach to substrate sheet 34 using two types of adhesives in the preferred embodiment of the present invention. A small patch 64 of a non-conductive adhesive is applied between the spaces between traces 54 and 56 where lights 20 are to reside. Non-conductive adhesive patch 64 serves two purposes. In the first place, it helps hold bodies 62 of lights 20 so that the entire weight of lights 20 need not be supported at leads 58 and 60. This improves the reliability of attachment for lights 20. In the second place, non-conductive adhesive patch 64 provides a minor barrier between traces 54 and 56. This minor barrier helps keep conductive adhesive patches 66, discussed below, from extending over the space between traces 54 and 56 to cause a short. Since adhesive patch 64 is non-conductive, no short occurs if it contacts both of traces 54 and 56. Moreover, since adhesive patches 64 cover only small, discrete, individual areas of substrate sheet 34, the cured flexibility of patch 64 is of little importance. Any suitable non-conductive adhesive may suffice for patches 64.

Conductive adhesive patches 66 attach leads 58 and 60 to conductive traces 38. A conductive adhesive is used to insure good electrical connection. Preferably, patches 66 cover only small areas, and care is taken to insure that patches 66 do not cause unwanted shorts. Since adhesive patches 66 cover only small, discrete, individual areas of substrate sheet 34, the cured flexibility of patches 66 is of little importance. Any suitable conductive adhesive may suffice for patches 66.

Figure 6:
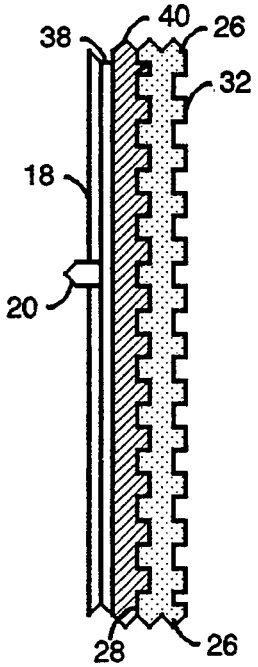
FIG. 6 shows a side view of a section of a second embodiment of the illuminated fabric article.

FIG. 6 shows a side view of a section of a second embodiment of illuminated fabric article 10. In the first embodiment, discussed above in connection with FIG. 2, film 40 was juxtaposed with textile 26 on the interior side 32 of textile 26. In this second embodiment, film 40 is applied to exterior side 28 of textile 26. When article 10 is worn as an article of clothing, textile 26 resides between film 40 and skin 12 (see FIG. 1). Thus, textile 26 provides the strength and comfort attributes rather than the woven backing 42, discussed above in connection with FIG. 2. Film 40 may be applied by silk screening or in any other manner known to those skilled in the art.

As discussed above in connection with the first embodiment, conductive traces 38 are applied to film 40. Light 20 attaches to film 40, and its leads couple to conductive traces 38 as discussed above in connection with FIG. 4. Design 18 may then be applied over conductive traces 38 and film 40 by silk screening or in any other manner known to those skilled in the art.

In summary, the present invention provides an improved illuminated fabric article. The illuminated fabric article of the present invention promotes comfort to a wearer due, among other things, to the use of a substrate sheet that has the pliability characteristics of woven cloth. These characteristics include extreme pliability, little or no resilience, and an ability to breath and wick moisture. Moreover, due to the use of flexible conductive inks and common fabric materials, the present invention provides an article of illuminated clothing that is inexpensive.

The present invention has been described above with reference to preferred embodiments. However, those skilled in the art will recognize that changes and modifications may be made in these preferred embodiments without departing from the scope of the present invention. For example, other types of active light sources than LEDs may be used in accordance with the present invention. These and other changes and modifications which are obvious to those skilled in the art are intended to be included within the scope of the present invention.

What is claimed is:

1. An illuminated fabric article which substantially exhibits cloth-like pliability and low resilience, said article comprising:

a textile having a first side and a second side;

an electrically insulating substrate sheet juxtaposed with said textile on said first side of said textile, said sheet comprising:

a woven cloth backing, and a substantially continuous, pliable film covering said cloth backing;

a flexible conductive ink residing on a surface of said film and configured to form first and second conductive traces thereon; and at least one light physically attached to said film, said at least one light being visible from said second side of said textile.

2. An illuminated fabric article as claimed in claim 1 wherein said film comprises flexible polymers.

3. An illuminated fabric article as claimed in claim 1 wherein:

said light has first and second conductive leads protruding therefrom;

said first and second conductive traces are separated by a space; and said article additionally comprises a non-conductive adhesive attaching said light to said sheet in said space which separates said first and second conductive traces.

4. An illuminated fabric article as claimed in claim 1 wherein:

said light has first and second leads protruding therefrom;

said first and second conductive traces are separated by a space; and said article additionally comprises a first conductive adhesive positioned to attach said first lead to said first conductive trace and a second conductive adhesive positioned to attach said second lead to said second conductive trace.

5. An illuminated fabric article as claimed in claim 1 wherein said flexible conductive ink comprises a liquid polymeric ink bearing conductive particles.

6. An illuminated fabric article which substantially exhibits cloth-like pliability and low resilience, said article comprising:

a textile having an exterior side and an interior side;

a substantially continuous, pliable film juxtaposed with said textile on said exterior side of said textile;

a flexible conductive ink residing on a surface of said film and configured to form first and second conductive traces thereon; and at least one light physically attached to said film, said at least one light being visible from said exterior side of said textile.

7. An illuminated fabric article for wearing over a portion of a body and for promoting comfort, said article comprising:

a garment material having an exterior side and an interior side;

an electrically insulating substrate sheet juxtaposed with said garment material, said sheet being sufficiently pliable so that when said sheet is forced against said body until deformation of said sheet occurs, pressure exerted by said sheet against said body after deformation of said sheet occurs is approximately equal to or less than an opposing pressure said body exerts on said sheet, said sheet comprising:

a woven cloth backing, and a substantially continuous film covering said cloth backing;

conductive traces being applied to said film of said sheet; and at least one light physically attached to said film of said sheet, said at least one light being arranged to be visible from said exterior side of said garment material.

8. An illuminated fabric article as claimed in claim 7, wherein said sheet resides on said exterior side of said garment material.

9. An illuminated fabric article as claimed in claim 7, wherein said film comprises flexible polymers.

10. An illuminated fabric article as claimed in claim 7, wherein:

said light has first and second conductive leads protruding therefrom;

said conductive traces are configured as first and second conductive traces separated by a space; and said article additionally comprises a non-conductive adhesive attaching said light to said sheet in said space which separates said first and second conductive traces.

11. An illuminated fabric article as claimed in claim 7, wherein:

said light has first and second leads protruding therefrom;

said conductive traces are configured as first and second conductive traces separated by a space; and said article additionally comprises a first conductive adhesive positioned to attach said first lead to said first conductive trace and a second conductive adhesive positioned to attach said second lead to said second conductive trace.

12. An illuminated fabric article as claimed in claim 7, wherein said conductive traces comprise a flexible conductive ink.

13. An illuminated fabric article as claimed in claim 12, wherein said flexible conductive ink comprises a liquid polymeric ink bearing conductive particles.

14. An illuminated fabric article which substantially exhibits cloth-like pliability and low resilience, said article comprising:

a textile having an exterior side and an interior side;

an electrically insulating, substantially continuous, film covering a portion of said exterior side of said textile, said film having an interior side facing said textile and an exterior side opposing said film interior side; a flexible conductive ink residing on said exterior side of said film and configured to form first and second conductive traces thereon, said first and second conductive traces separated by a space; and at least one light physically attached to said exterior side of said film, said at least one light being electrically coupled to said conductive traces, said light having first and second conductive leads protruding therefrom; and a non-conductive adhesive attaching said light to said film in said space which separates said first and second conductive traces.

15. An illuminated fabric article as claimed in claim 14, wherein said article additionally comprises a first conductive adhesive positioned to attach said first lead to said first conductive trace and a second conductive adhesive positioned to attach said second lead to said second conductive trace.

16. An illuminated fabric article as claimed in claim 14 wherein said flexible conductive ink comprises a liquid polymeric ink bearing conductive particles.

* * * * *